US009409663B2

(12) United States Patent
Dabek et al.

(10) Patent No.: US 9,409,663 B2
(45) Date of Patent: Aug. 9, 2016

(54) PRODUCT DISPENSING SYSTEM TO MAINTAIN PRODUCT HOMOGENEITY OR PRODUCE A HOMOGENOUS FLUID-PARTICULATE MIXTURE

(71) Applicants: Jaroslaw Dabek, Lake Grove, NY (US); Syed Zaki Hossain, Hicksville, NY (US)

(72) Inventors: Jaroslaw Dabek, Lake Grove, NY (US); Syed Zaki Hossain, Hicksville, NY (US)

(73) Assignee: Modern Packaging, Inc, Deer Park, NY (US)

( * ) Notice: Subject to any disclaimer, the term of this patent is extended or adjusted under 35 U.S.C. 154(b) by 86 days.

(21) Appl. No.: 14/339,001

(22) Filed: Jul. 23, 2014

(65) Prior Publication Data

US 2015/0028060 A1 Jan. 29, 2015

Related U.S. Application Data

(60) Provisional application No. 61/857,540, filed on Jul. 23, 2013.

(51) Int. Cl.
*G01F 11/00* (2006.01)
*B65B 37/06* (2006.01)

(52) U.S. Cl.
CPC ..... *B65B 37/06* (2013.01); *B65B 2210/10* (2013.01)

(58) Field of Classification Search
CPC ..... B65B 37/06; B65B 2210/10
USPC ..... 222/233–235
See application file for complete search history.

(56) References Cited

U.S. PATENT DOCUMENTS

| | | | | | |
|---|---|---|---|---|---|
| 1,960,435 | A * | 5/1934 | Dudley | B01F 15/0201 | 196/46 |
| 2,174,319 | A * | 9/1939 | Gastrow | B29C 45/72 | 222/146.5 |
| 2,716,510 | A * | 8/1955 | Massmann | B65B 3/32 | 222/227 |
| 3,015,415 | A * | 1/1962 | Marsh | B01F 13/1058 | 222/135 |
| 3,052,376 | A * | 9/1962 | Fogg | B01F 15/0454 | 222/227 |
| 5,356,041 | A * | 10/1994 | Hellenberg | B01F 13/1058 | 141/103 |
| 5,409,137 | A * | 4/1995 | Bonomelli | B65B 29/02 | 222/217 |
| 5,419,464 | A * | 5/1995 | Ganrot | G01F 11/021 | 222/380 |
| 2003/0071073 | A1* | 4/2003 | Zimmet | B29C 45/532 | 222/234 |
| 2010/0078449 | A1* | 4/2010 | Dabek | F16K 5/02 | 222/380 |

* cited by examiner

*Primary Examiner* — Patrick M Buechner
(74) *Attorney, Agent, or Firm* — Carter, DeLuca, Farrell & Schmidt, LLP

(57) ABSTRACT

A product dispensing system includes a hopper, a housing defining an outlet lumen in communication with the hopper, an exit port, a valve, and a piston. The valve is transitionable between a closed position, wherein the exit port is closed off from the outlet lumen, and an open position, establishing communication between the outlet lumen and the exit port. The piston is movable from a first use position, wherein the piston partially occupies the outlet lumen, to a storage position, wherein the piston fully occupies the outlet lumen to urge any product mixture in the outlet lumen back into the hopper. The piston may further be movable between the first use position and a second use position to draw the product mixture from the hopper into the outlet lumen and to urge the product mixture out of the exit port.

9 Claims, 1 Drawing Sheet

PRODUCT DISPENSING SYSTEM TO MAINTAIN PRODUCT HOMOGENEITY OR PRODUCE A HOMOGENOUS FLUID-PARTICULATE MIXTURE

CROSS-REFERENCE TO RELATED APPLICATIONS

This application claims the benefit of and priority to U.S. Provisional Patent Application No. 61/857,540, filed on Jul. 23, 2013, the entire contents of which are hereby incorporated herein by reference.

BACKGROUND

1. Technical Field

The present disclosure relates to product dispensing and, more particularly, to a product dispensing system for dispensing a homogenous fluid-particulate mixture.

2. Background of Related Art

With respect to products containing a fluid-particulate mixture, it is often necessary to continuously agitate or mix such products prior to and during dispensing of the product into a packaging container to ensure the product mixture dispensed into the packaging container is homogenous. A typical product dispensing system for such purpose includes a hopper configured to retain the product mixture prior to dispensing, an agitator disposed within the hopper and configured to agitate and/or mix the product to help ensure homogeneity, and an outlet coupled between the hopper and a nozzle or other suitable dispenser for dispensing the product into the packaging container. However, although the agitator is sufficient to maintain the homogeneity of the mixture within the hopper during use, the outlet may collect sediment or particulate when the system is not in use, thus resulting in a non-homogenous mixture.

SUMMARY

In accordance with embodiments of the present disclosure, a product dispensing system configured to dispense a product mixture is provided. The system includes a hopper, a housing coupled to the hopper and defining an outlet lumen in communication with the hopper, an exit port extending from the housing, a valve disposed within the outlet lumen, and a piston disposed within the outlet lumen. The valve is selectively transitionable between a closed position, wherein the exit port is closed off from the outlet lumen, and an open position, wherein communication between the outlet lumen and the exit port is established. The piston is disposed within the outlet lumen and is movable relative to the housing between a first use position, wherein the piston partially occupies the outlet lumen, and a storage position, wherein the piston fully occupies the outlet lumen. The piston is movable from the first use position to the storage position to urge any product mixture in the outlet lumen back into the hopper.

In embodiments, the system further includes an agitator disposed within the hopper and configured to facilitate mixing of a product mixture disposed within the hopper. The agitator, in embodiments, may include a plurality of blades disposed within the hopper and rotatable relative to the hopper.

In embodiments, the piston is movable between the first use position and the storage position only when the valve is disposed in the closed position.

In embodiments, the piston is further movable to a second use position wherein the piston occupies a smaller portion of the outlet lumen as compared to the first use position. More specifically, the piston is movable from the first use position to the second use position with the valve disposed in the closed position to draw the product mixture from the hopper into the outlet lumen. The piston is movable from the second use position back to the first use position with the valve disposed in the open position to urge the product mixture out of the exit port.

In embodiments, the valve is rotatable between the open and closed positions.

In embodiments, the piston is slidably and sealingly disposed within the outlet lumen of the housing.

In embodiments, the valve is configured such that, in the closed position, the valve seals off the exit opening.

BRIEF DESCRIPTION OF THE DRAWINGS

Various embodiments of the present disclosure are described hereinbelow with references to the drawings, wherein.

DETAILED DESCRIPTION OF THE EMBODIMENTS

Figure 1:
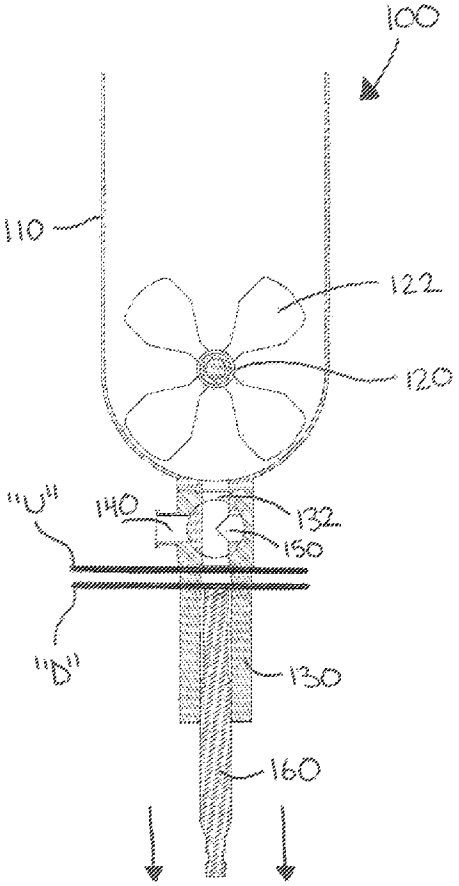
FIG. 1 is a longitudinal, cross-sectional view of a product dispensing system provided in accordance with the present disclosure, disposed in a first use position.
Figure 2:
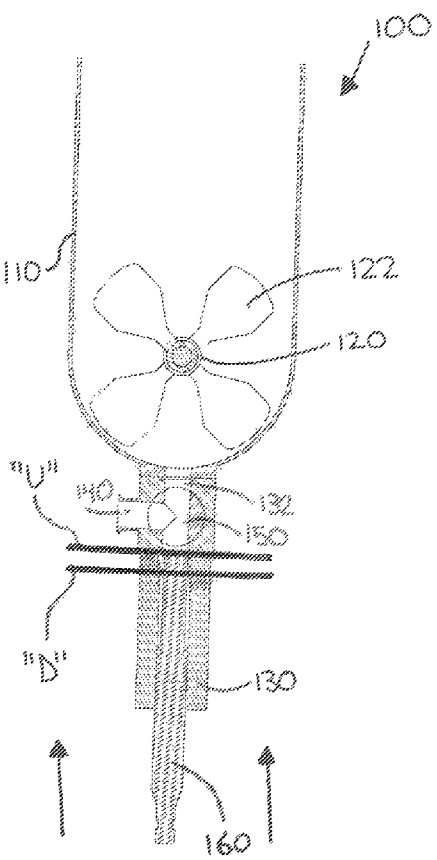
FIG. 2 is a longitudinal, cross-sectional view of the product dispensing system of FIG. 1, disposed in a second use position.
Figure 3:
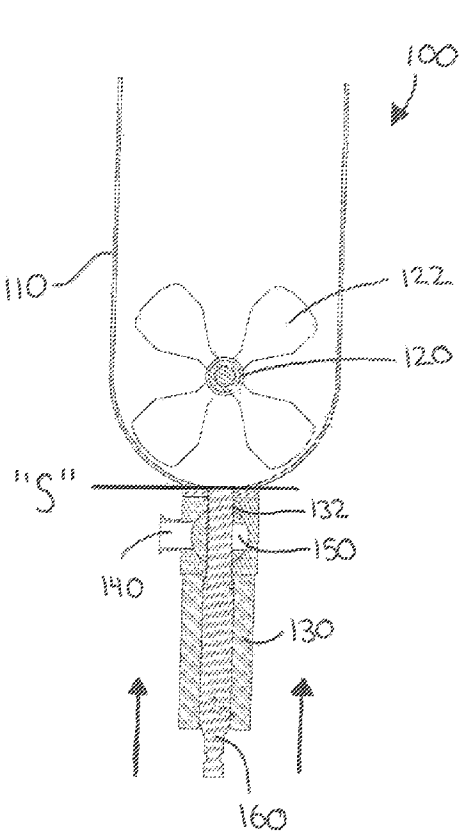
FIG. 3 is a longitudinal, cross-sectional view of the product dispensing system of FIG. 1, disposed in a stop position.

Turning to FIGS. 1-3, a product dispensing system provided in accordance with the present disclosure is shown and generally identified by reference numeral 100. Product dispensing system 100 includes a hopper 110, an agitator 120, a housing 130, an exit port 140, a valve 150, and a piston 160. Hopper 110 defines an interior chamber that is configured to retain a product mixture that is ultimately to be dispensed into a packaging container. Hopper 110 may be configured for receiving any suitable product, composition, mixture, and/or ingredients to be mixed prior to dispensing, e.g., into a packaging container, or further processing.

Agitator 120 is disposed within and coupled to hopper 110 for agitating and/or mixing the product to maintain homogeneity of the product mixture within hopper 110. More specifically, agitator 120 may include a plurality of blades 122 rotatable about common or different shafts and relative to hopper 110 to facilitate mixing of the product disposed within hopper 110. Agitator 120 may be oriented in any suitable fashion, e.g., depending upon the particular product to be dispensed from product dispensing system 100. Other suitable automatic agitators are also contemplated, as are manual agitators.

Housing 130 defines an outlet lumen 132 in communication with a bottom portion of hopper 110 and enables the product mixture to flow from hopper 110 to exit port 140. Exit port 140 is coupled to outlet lumen 132 of housing 130 and is configured to couple to a nozzle or other dispensing member (not shown) for dispensing the product mixture into a packaging container. As can be appreciated, housing 130 extends between exit port 140 and hopper 110 and serves to interconnect exit port 140 and the interior chamber of hopper 110. However, a portion of outlet lumen 132 of housing 130 extends beyond exit port 140, e.g., on the opposite side of exit port 140 as compared to hopper 110.

Valve 150 is operably coupled to housing 130 and is disposed within outlet lumen 132 of housing 130 between hopper 110 and exit port 140 for selectively permitting and inhibiting the product mixture to flow through outlet lumen 132, e.g., from hopper 110, through outlet lumen 132, and out exit port 140. Valve 150 is rotatable between a closed position, as shown in FIGS. 1 and 3, wherein exit port 140 is sealed or otherwise closed off from outlet lumen 132 to inhibit the flow of the product mixture from outlet lumen 132 out exit port 140, and an open position, as shown in FIG. 2, wherein exit port 140 is disposed in fluid communication with outlet lumen 132 to permit the flow of product mixture from outlet lumen 132 through exit port 140. In either position of valve 150, the interior chamber of hopper 110 remains disposed in fluid communication with outlet lumen 132 of housing 130. Although illustrated as a rotary valve, valve 150 may be configured as any suitable valve, e.g., depending upon the particular product mixture to be used therewith. Further, valve 150 may be manually or automatically actuated.

Piston 160 is slidably and sealingly disposed within outlet lumen 132 of housing 130. Piston 160 is slidable through and relative to outlet lumen 132 between at least a first position (FIG. 1) a second position (FIG. 2), and a third position (FIG. 3). In the first or down position "D," as shown in FIG. 1, piston 160 extends a first distance into the portion of outlet lumen 132 of housing 130 that is positioned beyond exit port 140. In the second or up position "U," as shown in FIG. 2, piston 160 extends further through outlet lumen 132 but still does not extend beyond exit port 140. As such piston 160 does not block or otherwise interfere with exit port 140 in the up and down positions "U" and "D," respectively. As detailed below, movement of piston 160 between the up and down positions "U" and "D," respectively, facilitates drawing the product mixture into outlet lumen 132 and expelling the product mixture from outlet lumen 132 the exit port 140. In the third or storage position "S," as shown in FIG. 3, piston 160 extends through outlet lumen 132 and valve 150 and is positioned to fully occupy outlet lumen 132. Thus, in this storage position "S," the entirety of the product mixture is urged into and retained within the interior chamber of hopper 110. Further, with piston 160 disposed in the storage position "S" wherein piston 160 extends through valve 150, valve 150 is disposed in the closed position and is inhibited from being manipulated from this closed position. Piston 160 may be any suitable piston, e.g., mechanical, hydraulic, pneumatic, etc., and may be manually or automatically actuated.

The use and operation of product dispensing system 100 is now detailed with reference to FIGS. 1-3. In the course of normal use of product dispensing system 100, product mixture disposed within hopper 110 is continually or periodically agitated and/or mixed via rotating blades 122 of agitator 120 to maintain homogeneity (or an acceptable mixture consistency). When product dispensing system 100 is in use, e.g., is mixing, but is not dispensing the product mixture, or when product dispensing system 100 is between uses that are close-in-time, valve 150 is disposed in the closed position, wherein exit port 140 is sealed closed, and piston 160 is disposed in the up position "U."

When it is desired to dispense the product mixture, initially, piston 160 is moved from the up position "U" to the down position "D," as shown in FIG. 1. This partial withdrawal of piston 160 from outlet lumen 132 of housing 130, via negative pressure, draws the product mixture from hopper 110 into outlet lumen 132.

Once the product mixture has been drawn from hopper 110 into outlet lumen 132 via the partial withdrawal of piston 160 from outlet lumen 132, valve 150 is transitioned to the open position, as shown in FIG. 2, wherein communication between exit port 140 and outlet lumen 132 via valve 150 is established. At this point, piston 160 is inserted further into outlet lumen 132 from the down position "D" back to the up position "U" to urge the product mixture disposed within outlet lumen 132 out exit port 140 and ultimately to the nozzle for dispensing the product. As can be appreciated, the above-described process is repeated to effect periodic dispensing of product into a packaging container, e.g., as each of a plurality of packaging containers is moved along a conveyor into position below the dispensing nozzle. During such use, agitator 120 maintains the product mixture disposed within hopper 110 in a homogenous state or at a desired consistency, while the continual withdrawal and insertion of piston 160 draws the homogenous mixture into outlet lumen 132 and urges the homogenous mixture through exit port 140 to facilitate dispensing.

However, when the above-noted process is stopped for a period of time, even where agitator 120 continues to run, sedimentation or particulate may collect in outlet lumen 132. Accordingly, when product dispensing system 100 is shut down or idle for a period of time (which may ultimately depend on the particular product mixture used), piston 160 may be moved to the stop position "S," as shown in FIG. 3, wherein piston 160 is positioned to urge and retain all of the product mixture within hopper 110. Thus, with all of the product mixture disposed within hopper 110 and within the accessible range of agitator 120, the product mixture may be maintained or returned to its homogeneous state even during prolonged non-use simply by running agitator 120. That is, re-homogenization prior to start-up from a period of non-use simply requires activation of agitator 120 without the need for dumping the portion of the product mixture that has collected within outlet lumen 132.

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments.

What is claimed is:

1. A product dispensing system configured to dispense a product mixture, comprising:

a hopper;

a housing coupled to the hopper and defining an outlet lumen in communication with the hopper;

an exit port extending from the housing;

a valve disposed within the outlet lumen and selectively transitionable between a closed position, wherein the exit port is closed off from the outlet lumen, and an open position, wherein communication between the outlet lumen and the exit port is established; and a piston disposed within the outlet lumen, the piston movable relative to the housing between a first use position, wherein the piston partially occupies the outlet lumen, and a storage position, wherein the piston fully occupies the outlet lumen, wherein, the piston is movable from the first use position to the storage position to urge any product mixture in the outlet lumen back into the hopper, and wherein piston is movable between the first use position and the storage position only when the valve is disposed in the closed position.

2. The system according to claim 1, further including an agitator disposed within the hopper, the agitator configured to facilitate mixing of a product mixture disposed within the hopper.

3. The system according to claim 1, wherein the agitator includes a plurality of blades disposed within the hopper and rotatable relative to the hopper.

4. The system according to claim 1, wherein the piston is further movable to a second use position wherein the piston occupies a smaller portion of the outlet lumen as compared to the first use position.

5. The system according to claim 4, wherein the piston is movable from the first use position to the second use position with the valve disposed in the closed position to draw the product mixture from the hopper into the outlet lumen.

6. The system according to claim 4, wherein the piston is movable from the second use position back to the first use position with the valve disposed in the open position to urge the product mixture out of the exit port.

7. The system according to claim 1, wherein the valve is rotatable between the open and closed positions.

8. The system according to claim 1, wherein the piston is slidably and sealingly disposed within the outlet lumen of the housing.

9. The system according to claim 1, wherein, in the closed position, the valve seals off the exit opening.

* * * * *